US009145659B2

(12) United States Patent
Walz et al.

(10) Patent No.: US 9,145,659 B2
(45) Date of Patent: Sep. 29, 2015

(54) RIDE CONTROL SYSTEM

(71) Applicant: CNH Industrial America LLC, New Holland, PA (US)

(72) Inventors: Robert Walz, Burlington, IA (US); C. David Anderson, Burlington, IA (US); Matthew J. Hennemann, Burlington, IA (US); David J. Sanning, Burlington, IA (US); Nicholas S. Chibucos, Burlington, IA (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 14/373,263

(22) PCT Filed: Jan. 18, 2013

(86) PCT No.: PCT/US2013/022040

§ 371 (c)(1),
(2) Date: Jul. 18, 2014

(87) PCT Pub. No.: WO2013/109814

PCT Pub. Date: Jul. 25, 2013

(65) Prior Publication Data

US 2014/0379229 A1 Dec. 25, 2014

Related U.S. Application Data

(60) Provisional application No. 61/588,939, filed on Jan. 20, 2012.

(51) Int. Cl.

| | |
|---|---|
| ***E02F 9/22*** | (2006.01) |
| ***E02F 3/96*** | (2006.01) |
| *G06F 19/00* | (2011.01) |

(52) U.S. Cl.
CPC ..... *E02F 9/2207* (2013.01); *E02F 3/964* (2013.01); *E02F 9/2217* (2013.01)

(58) Field of Classification Search
CPC ..... E02F 9/22; E02F 3/96; G06F 19/00
USPC ..... 701/50, 58; 477/111
See application file for complete search history.

(56) References Cited

U.S. PATENT DOCUMENTS

| | | | |
|---|---|---|---|
| 5,147,172 | A | 9/1992 | Hosseini |
| 5,706,657 | A | 1/1998 | Amborski et al. |
| 5,733,095 | A | 3/1998 | Palmer et al. |
| 5,987,369 | A | 11/1999 | Kwak et al. |
| 7,121,608 | B2 | 10/2006 | Billger et al. |
| 7,467,035 | B2 | 12/2008 | Sayce-Jones |
| 7,784,581 | B1 | 8/2010 | Klas et al. |

(Continued)

FOREIGN PATENT DOCUMENTS

| | | | |
|---|---|---|---|
| DE | 19608758 | A1 | 9/1997 |

*Primary Examiner* — Tan Q Nguyen
(74) *Attorney, Agent, or Firm* — Patrick M. Sheldrake; Seyed V. Sharifi T.

(57) ABSTRACT

A ride control system uses speed, pressure, hand throttle, foot throttle and seat position information associated with a tractor-loader-backhoe to determine when to engage and disengage the ride control system for the tractor-loader-backhoe. Once the ride control system is engaged, the ride control system can be disengaged in response to either an operator command or a measured speed of the tractor-loader-backhoe being below a predetermined speed.

20 Claims, 8 Drawing Sheets

(56) References Cited

U.S. PATENT DOCUMENTS

| | | | | |
|---|---|---|---|---|
| 7,793,740 | B2 | 9/2010 | Thomson et al. | |
| 8,387,378 | B2 | 3/2013 | Payne et al. | |
| 8,682,550 | B2 * | 3/2014 | Nelson et al. | 701/58 |
| 2004/0199313 | A1 * | 10/2004 | Dellinger | 701/37 |
| 2005/0153816 | A1 * | 7/2005 | Yoda et al. | 477/111 |
| 2010/0125394 | A1 | 5/2010 | Portet | |

* cited by examiner

| Auto Ride Control Select Bit 0 | Auto Ride Control Select Bit 1 | Auto Ride Control Mode | Auto Ride Control Relay Output |
|---|---|---|---|
| Low | Low | OFF (no switch installed) | Not Activated |
| High | Low | ON | Always Activated |
| Low | High | OFF (switch installed) | Not Activated |
| High | High | AUTO | Activated based on Auto Mode Logic |

FIG. 6

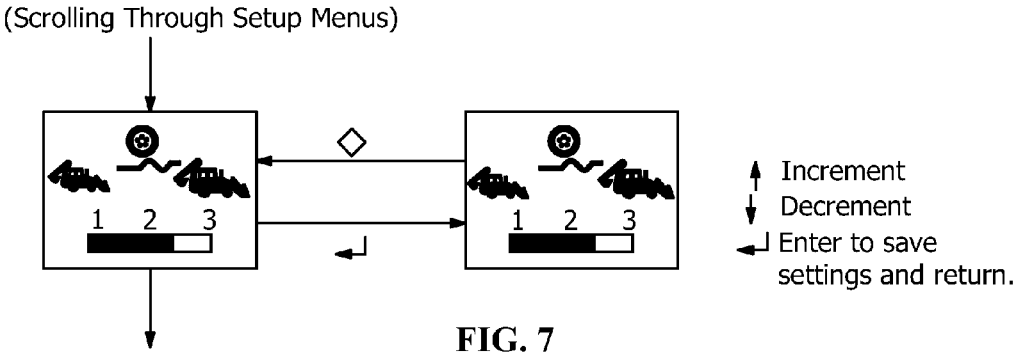

FIG. 7

| | Ride Control Relay Activate | Ride Control Relay De-Activate |
|---|---|---|
| Speed Threshold Setting = 1 | Above 9.2 Km/hour average wheel speed (5.7 MPH) | Below 7.6 Km/hour average wheel speed (4.7 MPH) |
| Speed Threshold Setting = 2 | Above 9.5 Km/hour average wheel speed (5.9 MPH) | Below 7.9 Km/hour average wheel speed (4.9 MPH) |
| Speed Threshold Setting = 3 | Above 9.9 Km/hour average wheel speed (6.2 MPH) | Below 8.4 Km/hour average wheel speed (5.2 MPH) |

FIG. 8

RIDE CONTROL SYSTEM

CROSS REFERENCE TO RELATED APPLICATIONS

This application is the US National Stage filing of International Application Serial No. PCT/US2013/022040 filed on Jan. 18, 2013 which claims priority to U.S. Provisional Application No. 61/588,939, filed Jan. 20, 2012, entitled RIDE CONTROL SYSTEM, each of which is hereby incorporated by reference in its entirety.

BACKGROUND

The present application relates generally to a ride control system for a tractor-loader-backhoe. The present application relates more specifically to controlling the automatic engagement of a ride control system for a tractor-loader-backhoe.

A tractor-loader-backhoe can include a ride control system to improve the machine's ride over all types of terrain with either an empty or loaded bucket. Ride control can reduce fore and aft pitching motion during transport and material hauling operations while allowing increased productivity and operator comfort. It also reduces shock loads to the machine. The ride control system can automatically control the level of damping or can incorporate a manual control to control the level of damping provided by the ride control system. The ride control system can also be configured to engage and disengage automatically. Several control methods can be used to control the activation/deactivation of the ride control system. For example, the speed of the tractor-loader-backhoe can be used to determine when to engage and disengage the ride control system.

In addition, tractor-loader-backhoes have other features or capabilities that need to be addressed in an automatically engaged ride control system. First, as the front loader of the tractor-loader-backhoe can be used as a stabilizer when performing backhoe operations, it is important that the automatic ride control system does not activate when the tractor-loader-backhoe is in the air. When the ride control valve is switched on, the rod end of the lift cylinders can be vented to the reservoir which can cause the tractor-loader-backhoe in the air to drop to the ground, causing an annoyance to the operator, or movement of the machine if the machine is in forward or reverse with 4-wheel drive activated. Second, it is important that the ride control system is not accidentally engaged when at a dealership and performing tests on the transmission, as often these tests are done with the machine raised with its wheels wholly off the ground. Furthermore, an operator does not want ride control on when digging below grade, or when dumping into a truck, as ride control can cause a loader to 'jump up" when a load is dumped.

Therefore, what is needed is a system and method to control the automatic engagement of a ride control system for a tractor-loader-backhoe.

SUMMARY

The present application is directed to a system and method for determining when to engage and disengage the ride control system for a tractor-loader-backhoe.

The present invention is directed to a method for controlling a ride control system for a vehicle. The method includes measuring a speed of the vehicle, comparing the measured speed to a predetermined speed, measuring a pressure associated with the vehicle and comparing the measured pressure to a predetermined threshold pressure. The method also includes determining whether a hand throttle for the vehicle is in a neutral position and determining whether a foot throttle for the vehicle has been used within a predetermined time period. The method further includes engaging a ride control system in response to the measured speed being greater than the first predetermined speed, the measured pressure being less than the predetermined threshold pressure, the hand throttle being in the neutral position and the foot throttle having been used within a predetermined time period.

The present invention is also directed to a ride control system for a vehicle. The ride control system includes a first sensor to measure a speed of a vehicle, a second sensor to measure a load of the vehicle, a third sensor to measure a position of a hand throttle for the vehicle, a fourth sensor to measure operation of a foot throttle for the vehicle and a microprocessor. The microprocessor is in communication with the first sensor, second sensor, third sensor and fourth sensor to receive signals from the first sensor, second sensor, third sensor and fourth sensor. The ride control system also includes a memory device storing a control algorithm to implement ride control on the vehicle. The microprocessor retrieves and executes the control algorithm in response to the measured speed being greater than a predetermined speed, the measured load being less than a predetermined threshold load, the hand throttle position being in the neutral position and the foot throttle operation having been used within a predetermined time period.

One advantage of the present application is a more comfortable ride for the operator of the tractor-loader-backhoe.

Another advantage of the present application is a more reliable activation and deactivation of the automatic ride control (ARC) system in a tractor-loader-backhoe by using the dual throttles, i.e., the existing hand and foot throttles, of the tractor-loader-backhoe to determine operator presence.

A further advantage of the present application is the use of existing inputs to determine the activation and deactivation of the automatic ride control (ARC) system in a tractor-loader-backhoe.

An additional advantage of the present application is that the operator is discouraged from using the hand throttle during "roading."

One advantage of the present application is the ability to "tune" the tractor-loader-backhoe to enable the automatic ride control (ARC) to engage and disengage depending on the vehicle applications, ground conditions or operator preference.

Other features and advantages of the present application will be apparent from the following more detailed description of the exemplary embodiments, taken in conjunction with the accompanying drawings.

BRIEF DESCRIPTION OF THE FIGURES

FIG. 6 shows a table with an exemplary embodiment of logic for selecting an automatic ride control operation.

FIG. 7 shows schematically an embodiment of a speed selection display.

FIG. 8 shows a table with an exemplary embodiment of speed threshold settings.

Wherever possible, the same reference numbers will be used throughout the drawings to refer to the same or like parts.

DETAILED DESCRIPTION OF THE EXEMPLARY EMBODIMENTS

Figure 1:
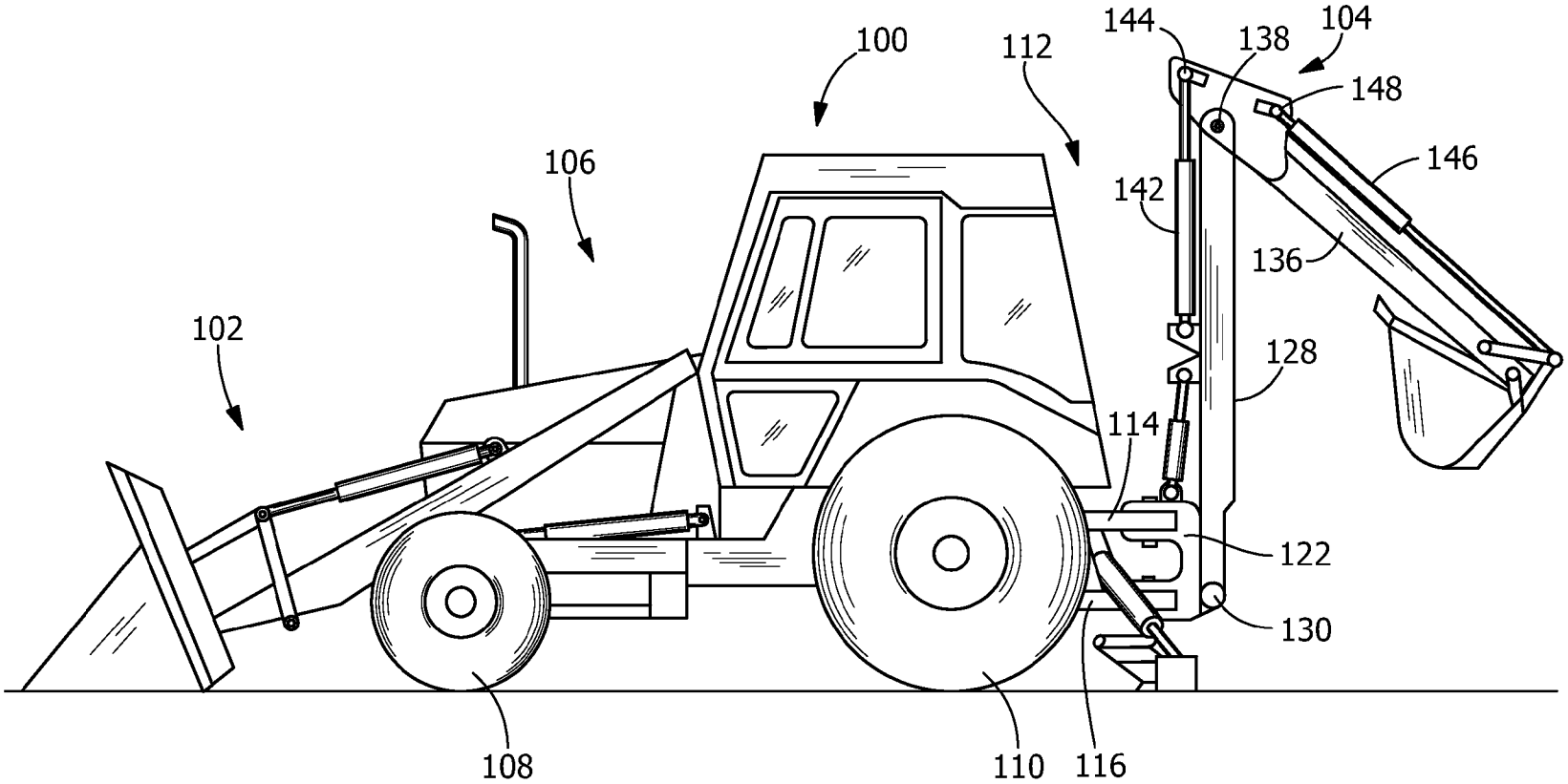
FIG. 1 shows a left side view of an exemplary embodiment of a tractor-loader-backhoe.

FIG. 1 shows an exemplary embodiment of a tractor-loader-backhoe 100 with a loader attachment 102 and a backhoe attachment 104. The loader attachment 102 and the backhoe attachment 104 are pivotally coupled to a tractor 106. The tractor 106 is supported on front wheels 108 and rear wheels 110 for movement over the ground. The rear 112 of the tractor-loader-backhoe 100 has two elongated extending members including upper member 114 and lower member 116 that extend from the rear 112. These members are positioned one above the other.

The backhoe attachment 104 is coupled to members 114 and 116 to pivot about a substantially vertical axis with respect to the tractor 106. In particular, a swing tower 122 is coupled to members 114 and 116 by pivot pin assemblies. The backhoe 104 also includes a boom 128 that is pivotally coupled to the swing tower 122 by a pivot pin assembly 130. The pivot pin assembly 130 defines a substantially horizontal pivotal axis between the boom 128 and the swing tower 122. The pivot pin assembly 130 extends through the swing tower 122 and the boom 128 to define a horizontal pivotal axis about which the boom 128 pivots with respect to the swing tower 122.

The backhoe attachment 104 also includes a dipper 136 that is pivotally coupled to the upper end of the boom 128. The dipper 136 is coupled to the boom 128 by a pivot pin assembly 138. The pivot pin assembly 138 defines a substantially horizontal pivotal axis about which the dipper 136 pivots with respect to the boom 128.

The backhoe attachment 104 also includes a hydraulic dipper cylinder 142 that is coupled to and between the boom 128 and the dipper 136 to pivot the dipper 136 with respect to the boom 128 when the hydraulic dipper cylinder 142 extends and retracts. The upper end of the hydraulic dipper cylinder 142 is pivotally coupled to the dipper 136 by a pivot pin assembly 144. The pivot pin assembly 144 extends through openings in both the dipper 136 and the upper end of the cylinder 142. The backhoe attachment 104 also includes a hydraulic bucket cylinder 146 that is pivotally coupled to the dipper 136 by a pivot pin assembly 148. The pivot pin assembly 148 defines a substantially horizontal pivotal axis between the dipper 136 and the bucket cylinder 146.

Figure 2:
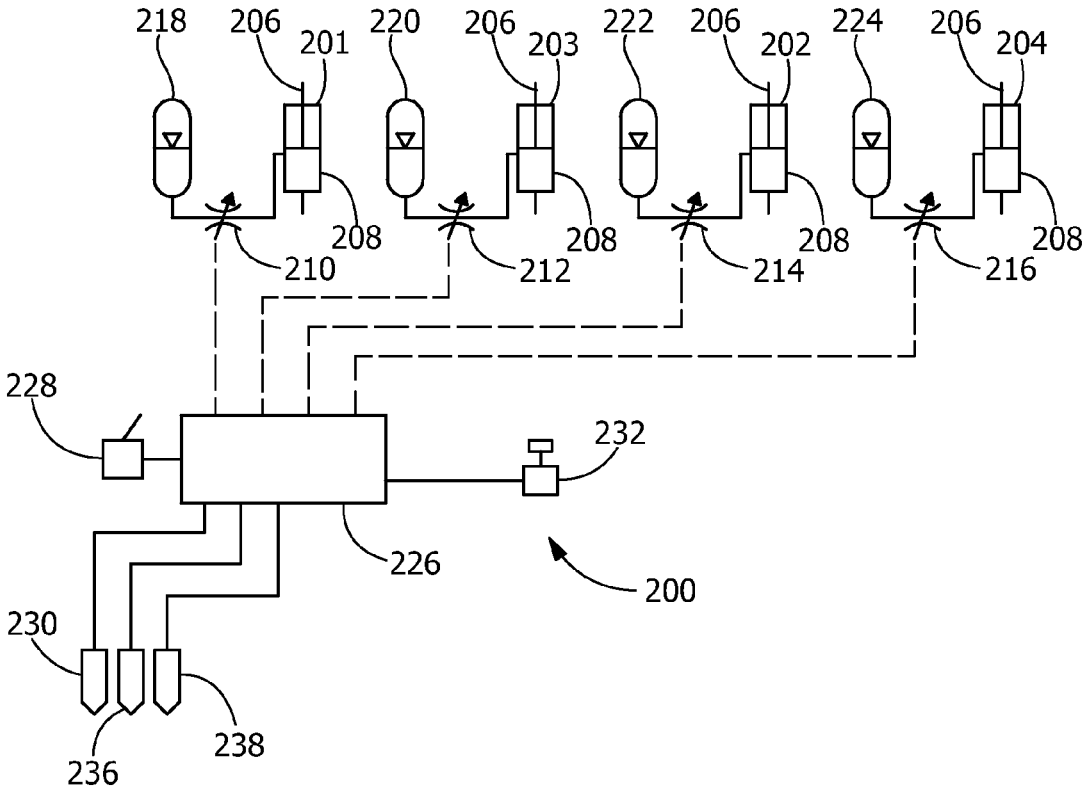
FIG. 2 shows an exemplary embodiment of a hydraulic control system for a tractor-loader-backhoe.

FIG. 2 shows an exemplary embodiment of a hydraulic control system 200 for a tractor-loader-backhoe 100. The system 200 can include a left front hydraulic cylinder 201 and a right front hydraulic cylinder 202 associated with wheel suspension arms for the front wheels 108 and a left rear hydraulic cylinder 203 and a right rear hydraulic cylinder 204 associated with wheel suspension arms for the rear wheels 110. The system 200 also includes variable orifices or valves 210, 212, 214, 216, gas-charged accumulators 218, 220, 222, 224, an electronic controller 226, a mode switch 228, a position sensor 230, a manually operable user input device 232, a velocity sensor 236, and a load sensor 238.

Each cylinder 201, 202, 203, 204 includes a rod portion 206 and a cylinder portion 208. The rod portion 206 is coupled to one of a wheel suspension arm and the chassis of the tractor-loader-backhoe 100 and the cylinder portion 208 is connected to the other of the wheel suspension arm and the chassis. When the wheel suspension arm to which each cylinder is attached moves up and down, it moves the rod portion 206 within the cylinder, alternately pulling in or pushing out hydraulic fluid. When the hydraulic fluid flows to and from the cylinders, it passes through variable orifices or valves 210, 212, 214, 216. The variable orifices or valves 210, 212, 214, 216 can be coupled to and between hydraulic fluid reservoirs (shown in FIG. 2 as gas-charged accumulators 218, 220, 222, 224) and cylinders 201, 202, 203, 204, respectively.

Variable orifices or valves 210, 212, 214, 216 are coupled to and controlled by the electronic controller 226. The controller 226 is configured to control the degree of opening of the orifices based upon either a manual input by the operator or based on a ride control algorithm that uses several parameters of operation, including the speed of the vehicle, the load on the vehicle (at the loader attachment 102 and/or at the backhoe attachment 104) and the degree of oscillation of the wheel suspension arms, to calculate the appropriate degree of opening or closing of the variable orifices 210, 212, 214, 216.

The controller 226 can be coupled to and receive signals from a mode switch 228, a position sensor 230, a velocity sensor 236, a load sensor 238, and a manually operable user input device 232. The mode switch 228 can be operated by the vehicle operator to select the mode of operation of the controller 226. The mode switch 228 can signal the controller 226 that ride control operation is either on, off, or automatic. In automatic ride control operation, the controller 226 determines when to engage and disengage ride control operation.

In one embodiment, the operator can use the input device 232 to set or control the amount of damping (i.e., the position of the orifices or valves 210, 212, 214, 216) implemented by the controller 226 when the ride control system is active. The input device 232 can be a potentiometer, a variable resistor, a shaft encoder or similar digital or analog output device that can be rotated or moved by the vehicle operator. The input device 232 can generate a signal proportional to its position and has several positions to provide for operator selection of several different levels of damping. When the operator places the mode switch 228 into the on or automatic position, the controller 226 responds to operator manipulation of the input device 232 by varying the opening of the variable orifices 210, 212, 214, 216 when the ride control system is active. In another exemplary embodiment, the input device 232 is not used or provided and the selection of the on or automatic mode of operation signals the controller 226 to control the opening of the variable orifices 210, 212, 214, 216 in accordance with the ride control algorithm.

The position sensor 230 can generate a signal indicating the position of a wheel suspension arm with respect to the chassis. In one embodiment, the sensor 230 is a potentiometer or variable resistor coupled to and between one wheel suspension arm and the chassis to sense movement of the wheel suspension arm with respect to the chassis. In another embodiment it is a radar unit coupled to the chassis and disposed to sense the distance between the chassis and the ground. In another embodiment it is an LVDT that is coupled to and between the chassis and a wheel suspension arm to sense the movement of the wheel suspension arm with respect to the chassis. All of these embodiments of the position sensor provide a signal that is indicative of the movement of the wheel suspension arm with respect to the chassis, either directly or indirectly.

The velocity sensor 236 is configured to generate a signal indicative of the speed of the tractor-loader-backhoe 100. In one embodiment, the velocity sensor 236 may be one or more speed sensors coupled to the tractor-loader-backhoe's drive motors or wheels. In another embodiment, the velocity sensor 236 may be a hydraulic fluid flow rate sensor (for tractor-loader-backhoes in which the flow rate is related to the speed of the tractor-loader-backhoe). In another embodiment the velocity sensor 236 may be a swash plate position sensor (for tractor-loader-backhoes in which the swash plate position of the pump is related to the speed of the tractor-loader-backhoe). In a further embodiment, the velocity sensor 236 may be connected to, or a part of, another microcontroller or microprocessor and may transmit its signal from that other microcontroller or microprocessor to the controller 226.

The load sensor 238 is configured to indicate the load on the tractor-loader-backhoe 100. In one embodiment, the load sensor 238 can be one or more pressure sensors that are coupled to one or more of the cylinders associated with the loader attachment 102 and/or the backhoe attachment 104 to generate a signal indicative of the load at the loader attachment 102 and/or the backhoe attachment 104, which is related to the tractor-loader-backhoe load. In another embodiment, the load sensor 238 may include one or more pressure sensors in fluid communication with one or more of hydraulic cylinders 201, 202, 203, 204.

Figure 10:
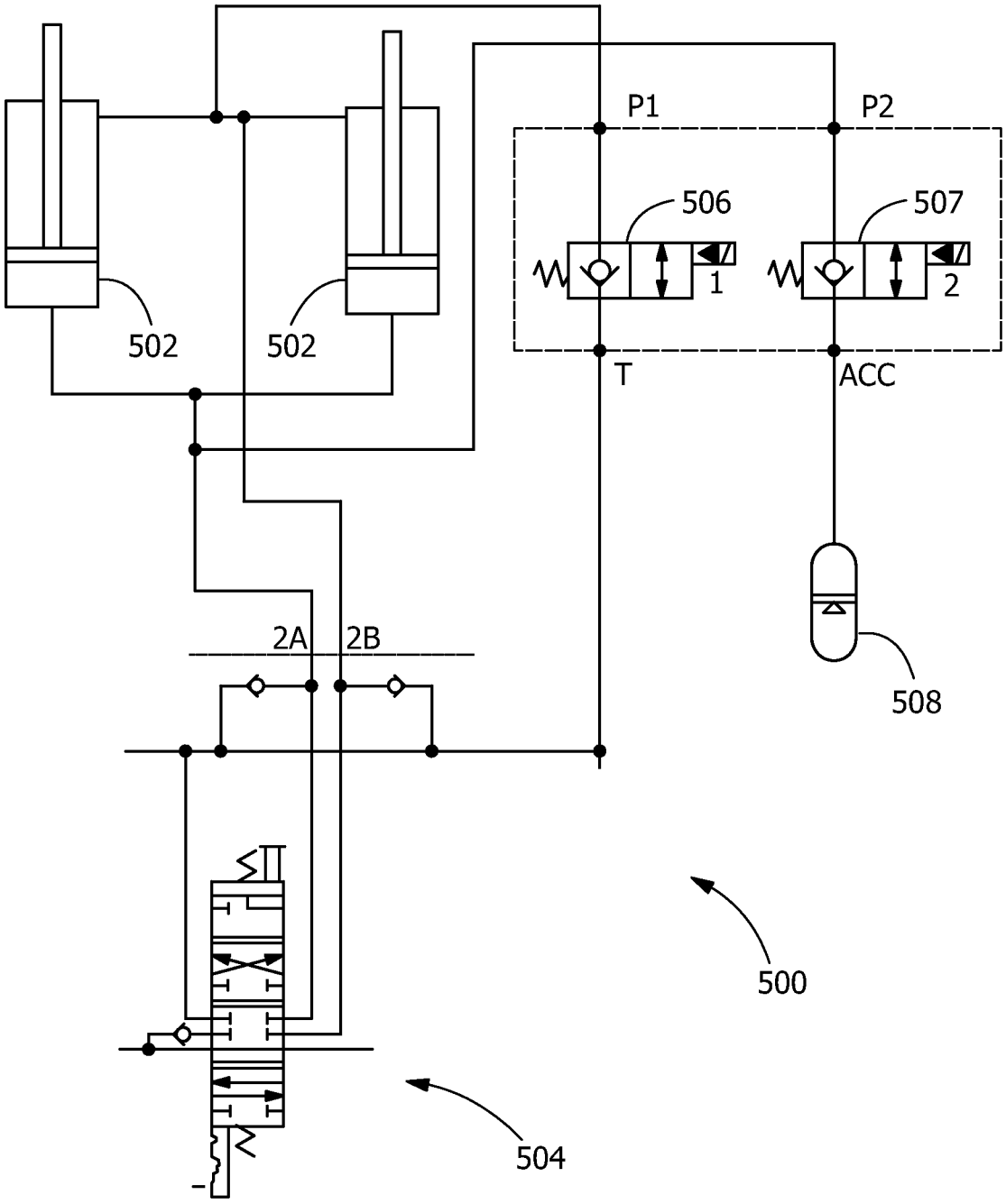
FIGS. 10 and 11 show exemplary embodiments of a hydraulic system for the loader arms of a tractor-loader-backhoe.
Figure 11:
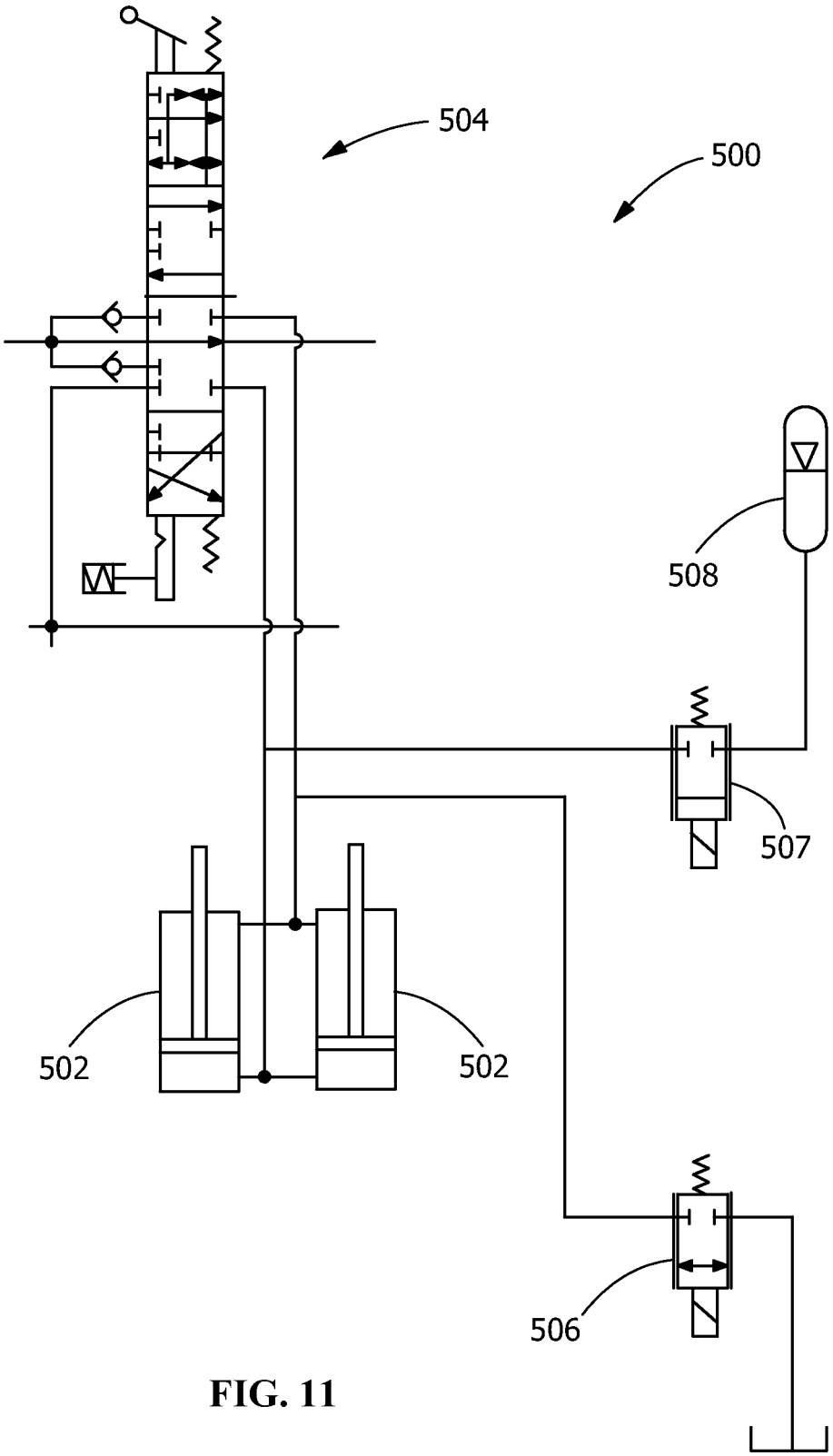

In another exemplary embodiment, the ride control system can dampen vibrations in the loader arm cylinders of the loader attachment 102 of the tractor-loader-backhoe 100. FIGS. 10 and 11 show exemplary embodiments of a hydraulic system for the loader arms of a tractor-loader-backhoe. As shown in FIGS. 10 and 11, the hydraulic system 500 for the loader arms can include loader lift cylinders 502 (to raise and lower the bucket of the loader), a loader lift section 504, two control valves to regulate fluid flow (air and hydraulic fluid) in the system including a tank control valve 506 and an accumulator control valve 507 and an accumulator 508 for hydraulic fluid. More specifically, the ride control system has an accumulator 508 in the loader lift circuit that cushions the loader arms. The ride control system can be turned on, off, or automatically turned on and off depending on the position of a switch 228, located on the instrument panel of the tractor-loader-backhoe. The switch 228 (when in the "on" of "auto on" position) shifts two solenoid valves, one that opens a path back to the tank, from the loader down circuit, and one that allows the accumulator to cushion the loader lift. When the ride control is on, the loader has no down pressure.

Figure 3:
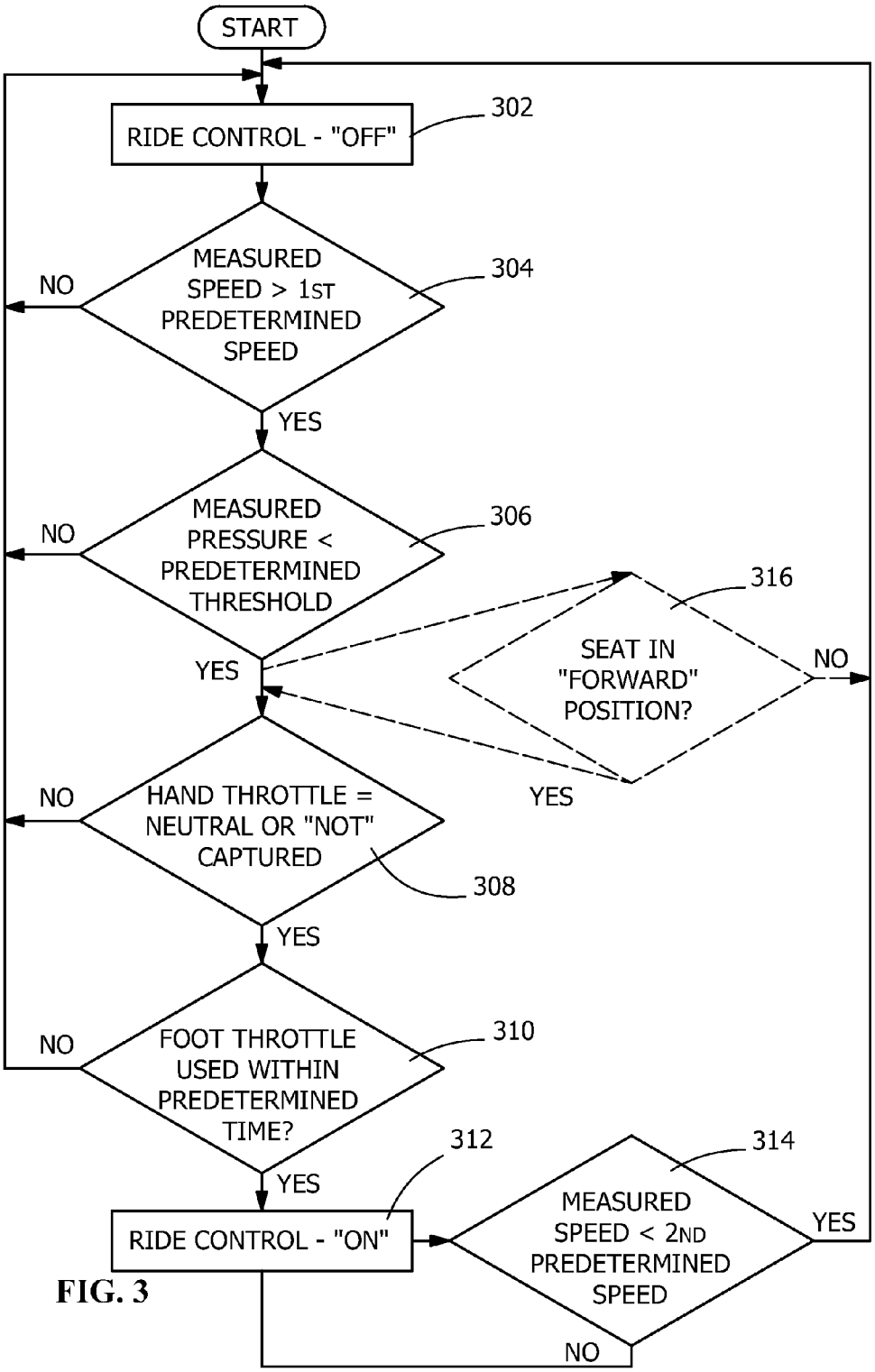
FIGS. 3 and 4 show exemplary embodiments of processes for determining when to engage and disengage a ride control system.
Figure 4:
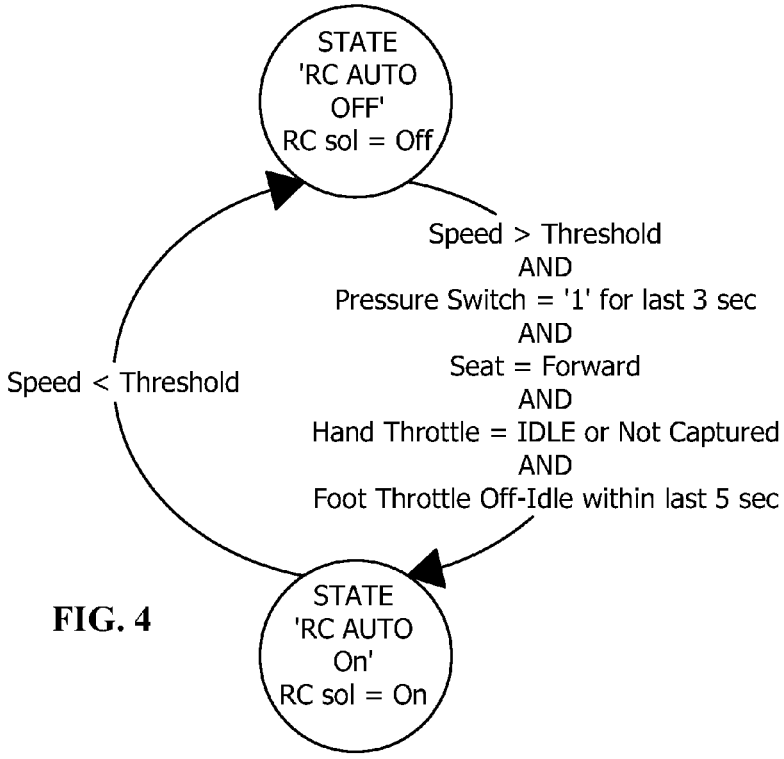

FIGS. 3 and 4 show exemplary embodiments of processes for automatically engaging and disengaging a ride control system. With reference to FIG. 3, the process starts out with the ride control system in the "off" state (step 302). Next, the speed of the tractor-loader-backhoe 100 is measured and compared to a first predetermined threshold speed (step 304). In one exemplary embodiment, the ground speed of the tractor-loader-backhoe 100 can be measured with a frequency-output, hall effect sensor located in the transmission. If the tractor-loader-backhoe speed is less than the first predetermined threshold speed, the process restarts with the ride control system remaining in the "off" state. Otherwise, the process continues and a pressure associated with the tractor-loader-backhoe 100 is measured and compared to a predetermined pressure threshold (step 306). In one exemplary embodiment, a pressure sensor or switch can be located in the loader lift circuit of the tractor-loader-backhoe 100 to measure the pressure. In another exemplary embodiment, the predetermined pressure threshold can be selected such that the ride control system cannot be engaged if the tractor-loader-backhoe 100 is statically off the ground. In a further embodiment, the pressure sensor or switch can be associated with the ride control hydraulics. In still a further embodiment, the pressure must be below the predetermined pressure threshold for a predetermined time period, e.g., 3 seconds, before the ride control system can be engaged.

If the tractor-loader-backhoe pressure is more than the predetermined threshold pressure, the process restarts with the ride control system remaining in the "off" state. Otherwise, the process continues and a hand throttle position for the tractor-loader-backhoe 100 is determined and compared to a predetermined state (step 308). In one exemplary embodiment, the position of the hand throttle can be measured or determined with an electronic hall effect throttle. In another exemplary embodiment, the predetermined state can be neutral or "not captured." The hand throttle becomes "not captured" as a result of certain events, for example, the operator seat is turned around or a service brake is depressed. The use of the hand throttle position can enable the process to determine the operator's position and enable the ride control system only when the operator is facing in the "forward" direction. In addition, the use of the hand throttle position can prevent the ride control system from engaging or activating when the tractor-loader-backhoe 100 is in the "backhoe position." For example, if the operator were lifting a heavy object, one heavy enough to lift the front of the tractor-loader-backhoe 100 off the ground, the pressure measured by the pressure switch could be low enough to allow activation of the ride control system if only pressure (or pressure and speed) were used to engage the ride control system.

If the hand throttle position is not in the predetermined state, the process restarts with the ride control system remaining in the "off" state. Otherwise, the process continues and a determination of whether a foot throttle operation for the tractor-loader-backhoe 100 has occurred within a predetermined time period is performed (step 310). In one exemplary embodiment, the operation of the foot throttle can be measured or determined with an electronic hall effect throttle. In another exemplary embodiment, the predetermined time period can be 5 seconds. The use of the foot throttle operation can enable the process to determine the operator's position and enable the ride control system only when the operator is facing in the "forward" direction and intending to use the tractor-loader-backhoe 100 in the forward direction. In addition, the use of the foot throttle criteria can ensure that the operator is in position to respond to an inadvertent movement of the tractor-loader-backhoe 100. For example, the operator has the ability to steer, brake or easily remove his foot from the throttle.

If a foot throttle operation does not occur with the predetermined time period, the process restarts with the ride control system remaining in the "off" state. Otherwise, the process continues and the ride control system is engaged or switched to the "on" state (step 312). When the ride control system is switched to the "on" state, or engaged, the microprocessor 226 can retrieve and execute a ride control algorithm from a memory device 415 (see FIG. 5). Once the ride control system is engaged or in the "on" state, the speed of the tractor-loader-backhoe 100 is measured and compared to a second predetermined threshold speed (step 314). In one exemplary embodiment, the second predetermined threshold speed can be the same as the first predetermined threshold speed. However, in another embodiment, the second predetermined threshold speed can be a predetermined amount less than the first predetermined threshold speed. If the tractor-loader-backhoe speed is less than the second predetermined threshold speed, the process restarts and the ride control system is disengaged and switched to the "off" state (step 302). In one embodiment, only speed is used to disengage the ride control system because the use of other criteria could permit random events (like a pressure spike, etc.) to disable the ride control system when it is not desired by the operator. For example, it is not desirable to allow the pressure switch to disable ride control after ride control has been enabled because if an operator is performing aggressive loader operations, an operator can trap a pressure high enough to "fool" the process into believing the machine is off the ground and therefore disable ride control. If the tractor-loader-backhoe speed is greater than the second predetermined threshold speed, the process continues with the ride control system in the "on" state and the speed of the tractor-loader-backhoe 100 is measured again and compared to the second predetermined speed (step 314).

In one exemplary embodiment, the process can also optionally determine whether the seat of the tractor-loader-backhoe 100 is in the forward direction or position (step 316) as a requirement for engaging the ride control system. The use of the seat position, when available, can enable the process to determine the operator's position and enable the ride control system only when the operator is facing in the "forward" direction. If the tractor-loader-backhoe seat is not in the forward position, the process restarts with the ride control system remaining in the "off" state. Otherwise, the process continues as previously described. As shown in FIG. 3, the seat position determination (step 316) is between the pressure evaluation (step 306) and the hand throttle evaluation (step 308). However, the seat position determination (step 316) can be completed at any point in the process prior to the engagement of the ride control system (step 312).

Figure 5:
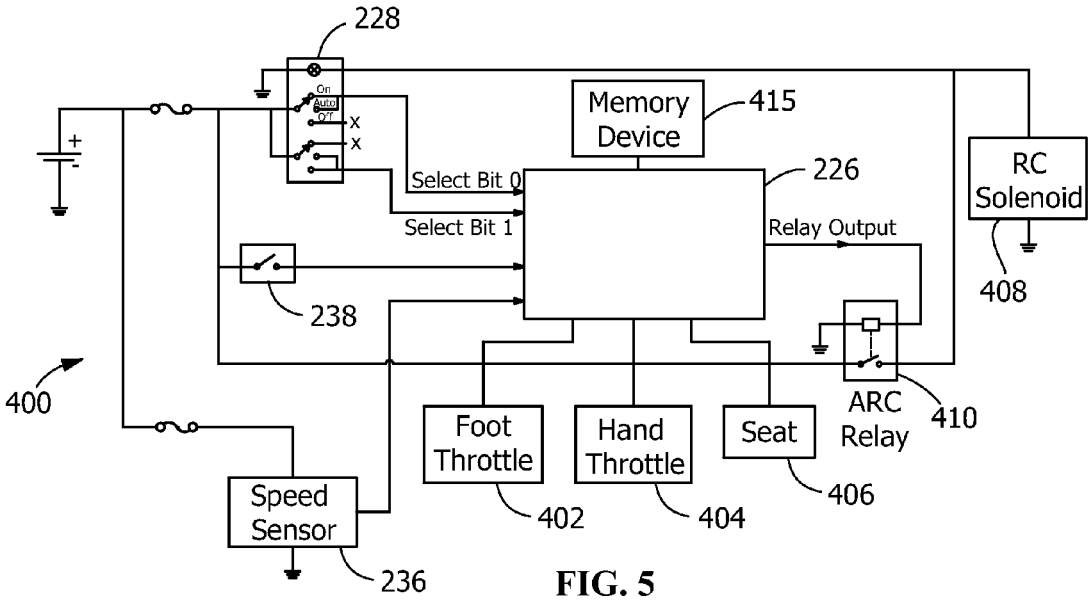
FIG. 5 shows an exemplary embodiment of a control circuit for an automatic ride control system.

FIG. 5 shows an exemplary embodiment of a control circuit 400 for an automatic ride control system that includes a foot throttle sensor 402, a hand throttle sensor or input 404 and seat position switch or input 406 associated with the control parameters set forth in FIGS. 3 and 4. The control circuit 400 also includes an automatic ride control (ARC) relay 410 that is controlled by the relay output from the controller 226. When activated by controller 226, ARC relay 410 in turn activates ride control (RC) solenoid 408. In one exemplary embodiment, the operator mode selection switch 228 illuminates when the ride control solenoid is signaled to activate by controller 226. FIG. 6 shows a table with logic for selecting an automatic ride control operation based on the position of a switch (or if no switch is present).

In one exemplary embodiment, the operator can select the first and second predetermined speed thresholds used by the processes of FIGS. 3 and 4 from several sets or settings of first and second speed thresholds. The operator can select the desired speed thresholds by adjusting the position of a switch or through the selection of the desired speed thresholds using a VCM menu interface such as the one shown in FIG. 7. FIG. 8 shows a table with speed threshold settings for an exemplary embodiment. In another exemplary embodiment, the operator can manually enter or establish, i.e., manually select, the first and second speed thresholds to obtain desired performance characteristics.

Figure 9:
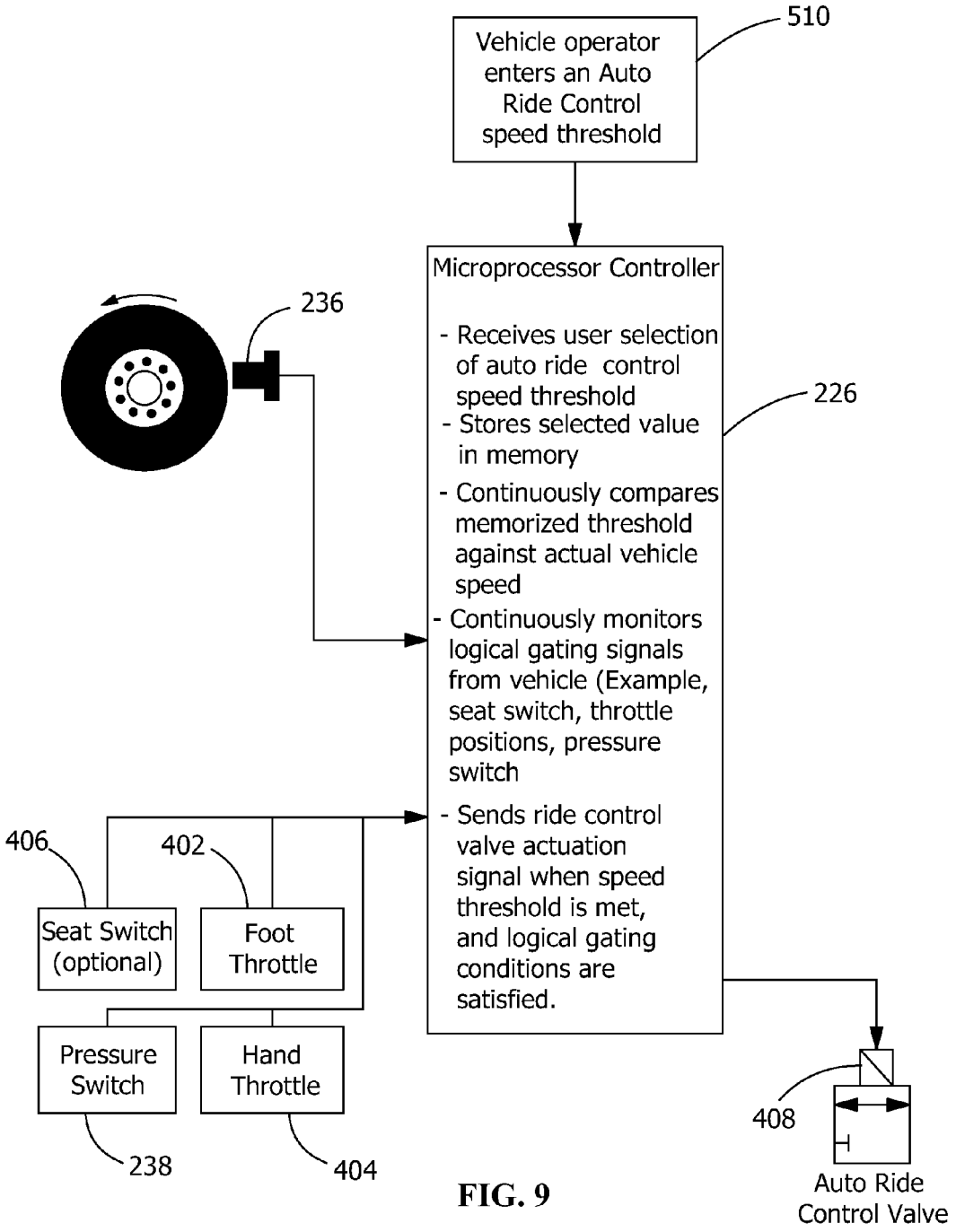
FIG. 9 shows schematically an exemplary process for engaging a ride control system with selectable speed thresholds.

FIG. 9 shows schematically an exemplary process for engaging a ride control system with selectable speed thresholds. The ride control system of FIG. 9 involves a mathematical averaging method of the signal inputs and can be applied to any vehicle with a ride control system that has a microprocessor controller and a speed sensor. An electronic vehicle speed sensor signal 236 is connected to the microprocessor controller 226. Electronic throttle signals 402, 404, pressure switch state 238, and in some cases, the seat switch 406 (if equipped), are connected to the microprocessor controller. An electronic input device 510, for operator adjustment of an automatic ride control (ARC) speed threshold, is connected to a microprocessor controller 226. The preceding signals are sampled at a periodic rate by the controller. One or more ARC speed threshold(s) are stored in the controller's memory. The current sampled vehicle speed value is stored in a memory location of the controller along with previous sampled values. The current sampled vehicle speed value is compared against the selected ARC speed threshold, to determine if the speed threshold has been met. The current sampled throttle, pressure, and seat signals are tested to determine if ARC activation threshold has been met. ARC is activated if both the preceding two qualifications are met and provides control signals to the auto ride control valves. ARC is deactivated if the sampled vehicle speed value is outside the stored ARC speed threshold. At any time, the vehicle operator can modify the ARC vehicle speed thresholds by using the electronic input device 510, which will modify the stored ARC speed threshold. The processes outlined above are continuously repeated by the microprocessor controller.

In one exemplary embodiment, the operator can set the speed thresholds for engaging and disengaging the ride control system while the tractor-loader-backhoe 100 is being operated.

In an exemplary embodiment, the automatic ride control system of the present application can be used with any work vehicle, such as wheel loaders, backhoes, excavators, skid steers, graders, trenchers, tractors, harvesters, balers, cotton pickers, forklifts, and other material handling or ground engaging vehicles, that use a ride control system.

It should be understood that the application is not limited to the details or methodology set forth in the following description or illustrated in the figures. It should also be understood that the phraseology and terminology employed herein is for the purpose of description only and should not be regarded as limiting.

The present application contemplates methods, systems and program products on any machine-readable media for accomplishing its operations. The embodiments of the present application may be implemented using existing computer processors, or by a special purpose computer processor for an appropriate system, or by a hardwired system.

Embodiments within the scope of the present application include program products comprising machine-readable media for carrying or having machine-executable instructions or data structures stored thereon. Machine-readable media can be any available non-transitory media that can be accessed by a general purpose or special purpose computer or other machine with a processor. By way of example, machine-readable media can include RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Although the figures herein may show a specific order of method steps, the order of the steps may differ from what is depicted. Also, two or more steps may be performed concurrently or with partial concurrence. Variations in step performance can depend on the software and hardware systems chosen and on designer choice. All such variations are within the scope of the application. Likewise, software implementations could be accomplished with standard programming techniques with rule based logic and other logic to accomplish the various connection steps, processing steps, comparison steps and decision steps.

In the further consideration of the drawings of this application and the discussion of such drawings and the elements shown therein, it should also be understood and appreciated that, for purposes of clarity in the drawings, pluralities of generally like elements positioned near to one another or extending along some distance may sometimes, if not often, be depicted as one or more representative elements with extended phantom lines indicating the general extent of such like elements. In such instances, the various elements so represented may generally be considered to be generally like the representative element depicted and generally operable in a like manner and for a like purpose as the representative element depicted.

Many of the fastening or connection processes and components utilized in the application are widely known and used, and their exact nature or type is not necessary for an understanding of the application by a person skilled in the art. Also, any reference herein to the terms "left" or "right" is used as a matter of mere convenience, and is determined by standing at the rear of the machine facing in its normal direction of travel. Furthermore, the various components shown or described herein for any specific embodiment in the application can be varied or altered as anticipated by the application and the practice of a specific embodiment of any element may already be widely known or used by persons skilled in the art.

It will be understood that changes in the details, materials, steps and arrangements of parts which have been described and illustrated to explain the nature of the application will occur to and may be made by those skilled in the art upon a reading of this disclosure within the principles and scope of the application. The foregoing description illustrates an exemplary embodiment of the invention; however, concepts, as based upon the description, may be employed in other embodiments without departing from the scope of the application.

While the application has been described with reference to an exemplary embodiment, it will be understood by those skilled in the art that various changes may be made and equivalents may be substituted for elements thereof without departing from the scope of the application. In addition, many modifications may be made to adapt a particular situation or material to the teachings of the application without departing from the essential scope thereof. Therefore, it is intended that the application not be limited to the particular embodiment disclosed as the best mode contemplated for carrying out this application, but that the invention will include all embodiments falling within the scope of the appended claims.

What is claimed is:

1. A method for controlling a ride control system for a vehicle, the method comprising:

measuring a speed of a vehicle;

comparing the measured speed to a predetermined speed;

measuring a pressure associated with the vehicle;

comparing the measured pressure to a predetermined threshold pressure;

determining whether a hand throttle for the vehicle is in a neutral position;

determining whether a foot throttle for the vehicle has been used within a predetermined time period; and engaging a ride control system in response to the measured speed being greater than the predetermined speed, the measured pressure being less than the predetermined threshold pressure, the hand throttle being in the neutral position and the foot throttle having been used within a predetermined time period.

2. The method of claim 1 further comprising:

determining whether a seat of the vehicle is in the forward position; and said engaging a ride control system comprises engaging the ride control system in response to the measured speed being greater than the predetermined speed, the measured pressure being less than the predetermined threshold pressure, the seat being in the forward position, the hand throttle being in the neutral position and the foot throttle having been used within a predetermined time period.

3. The method of claim 1 further comprising:

selecting a ride control state from the group consisting of on, off and automatic;

disengaging the ride control system in response to the selection of the off ride control state;

engaging the ride control system in response to the selection of the on ride control state; and performing said measuring the speed, said comparing the measured speed, said measuring a pressure, said comparing the measured pressure, said determining whether a hand throttle for the vehicle is in a neutral position, said determining whether a foot throttle for the vehicle has been used within a predetermined time period, and said engaging a ride control system in response to the selection of the automatic ride control state.

4. The method of claim 1 further comprising:

the predetermined speed being a first predetermined speed;

measuring the speed of the vehicle after engagement of the ride control system;

comparing the measured speed of the vehicle after engagement of the ride control system with a second predetermined speed; and disengaging the ride control system in response to the measured speed of the vehicle after engagement being less than the second predetermined speed.

5. The method of claim 4 wherein the second predetermined speed is equal to or less than the first predetermined speed.

6. The method of claim 4 further comprising selecting a speed threshold setting, the speed threshold setting including a first predetermined value for the first predetermined speed and a second predetermined value for the second predetermined speed.

7. The method of claim 6 wherein said selecting a speed threshold setting includes selecting the speed threshold setting from a plurality of predetermined speed threshold settings having different values for the first predetermined value and the second predetermined value.

8. The method of claim 1 further comprising preventing engagement of the ride control system in response to the measured speed being less than the predetermined speed, the measured pressure being greater than the predetermined threshold pressure, the hand throttle being in an active position and the foot throttle having not been used within a predetermined time period.

9. The method of claim 1 wherein:

said comparing the measured pressure includes determining if the measured pressure is below the predetermined threshold pressure for a predetermined time period; and said engaging a ride control system comprises engaging the ride control system in response to the measured speed being greater than the first predetermined speed, the measured pressure being less than the predetermined threshold pressure for the predetermined time period, the hand throttle being in the neutral position and the foot throttle having been used within a predetermined time period.

10. The method of claim 9 further comprising preventing engagement of the ride control system in response to the measured pressure being less than the predetermined threshold pressure for less than the predetermined time period.

11. A ride control system for a vehicle comprising:

a first sensor to measure a speed of a vehicle;

a second sensor to measure a load of the vehicle;

a third sensor to measure a position of a hand throttle for the vehicle;

a fourth sensor to measure operation of a foot throttle for the vehicle;

a microprocessor, the microprocessor being in communication with the first sensor, second sensor, third sensor and fourth sensor to receive signals from the first sensor, second sensor, third sensor and fourth sensor;

a memory device storing a control algorithm to implement ride control on the vehicle; and the microprocessor retrieving and executing the control algorithm in response to the measured speed being greater than a predetermined speed, the measured load being less than a predetermined threshold load, the hand throttle position being in the neutral position and the foot throttle operation having been used within a predetermined time period.

12. The ride control system of claim 11 further comprising:

a fifth sensor to measure a position of a seat of the vehicle; and the microprocessor retrieving and executing the control algorithm in response to the measured speed being greater than a predetermined speed, the measured load being less than a predetermined threshold load, the measured seat position being in a forward position, the hand throttle position being in the neutral position and the foot throttle operation having been used within a predetermined time period.

13. The ride control system of claim 11 further comprising:

an input device, the input device enabling an operator to select a ride control state from the group consisting of on, off and automatic;

the microprocessor stops executing the control algorithm in response to the selection of the off ride control state on the input device;

the microprocessor executes the control algorithm in response to the selection of the on ride control state on the input device; and the microprocessor retrieves and executes the control algorithm in response to the selection of the automatic ride control state on the input device, the measured speed being greater than a predetermined speed, the measured load being less than a predetermined threshold load and the foot throttle operation having been used within a predetermined time period.

14. The ride control system of claim 11 wherein:

the predetermined speed being a first predetermined speed;

the first sensor measuring an additional speed of the vehicle during execution of the control algorithm; and the microprocessor stopping execution of the control algorithm in response to the measured additional speed of the vehicle being less than a second predetermined speed.

15. The ride control system of claim 14 wherein the second predetermined speed is equal to or less than the first predetermined speed.

16. The ride control system of claim 14 further comprising an input device, the input device enabling an operator to select a speed threshold setting, the speed threshold setting including a first predetermined value for the first predetermined speed and a second predetermined value for the second predetermined speed.

17. The ride control system of claim 16 wherein the speed threshold setting includes a plurality of predetermined speed threshold settings having different values for the first predetermined value and the second predetermined value.

18. The ride control system of claim 11 wherein the second sensor comprises a pressure sensor to measure a pressure in a loader lift circuit of the vehicle.

19. The ride control system of claim 11 wherein the predetermined time period is 5 seconds.

20. The ride control system of claim 11 wherein the control algorithm dampens vibrations in loader arm cylinders of a loader attachment of the vehicle.

* * * * *